US005791179A

United States Patent [19]

Brask

[11] Patent Number: 5,791,179

[45] Date of Patent: Aug. 11, 1998

[54] REMOTE CONTROL MOTOR DRIVEN LOCKING MECHANISM

[76] Inventor: James E. Brask, 2245 Radatz Ave., Maplewood, Minn. 55109

[21] Appl. No.: 695,129

[22] Filed: Aug. 8, 1996

[51] Int. Cl.[6] ..... E05B 47/02

[52] U.S. Cl. ..... 70/278; 70/110; 70/280; 70/283; 292/142; 292/144; 292/153; 292/DIG. 51

[58] Field of Search ..... 70/110, 277–283; 292/142, 144, 153, DIG. 51

[56] References Cited

U.S. PATENT DOCUMENTS

| | | | |
|---|---|---|---|
| 323,918 | 8/1885 | Crockett et al. | 70/277 |
| 478,781 | 7/1892 | Candee | 292/DIG. 51 X |
| 1,720,590 | 7/1929 | Evans | 292/142 X |
| 3,895,505 | 7/1975 | Wasserfaller | 70/111 |
| 3,933,382 | 1/1976 | Counts et al. | 70/280 X |
| 4,833,465 | 5/1989 | Abend et al. | 292/144 X |
| 5,521,443 | 5/1996 | Imura et al. | 180/287 X |
| 5,531,086 | 7/1996 | Bryant | 292/144 X |
| 5,546,777 | 8/1996 | Liu et al. | 70/280 X |
| 5,626,039 | 5/1997 | Solari et al. | 70/280 X |

FOREIGN PATENT DOCUMENTS

| | | | |
|---|---|---|---|
| 106846 | 7/1927 | Austria | 70/110 |
| 475613 | 6/1915 | France | 292/142 |
| 2505391 | 11/1982 | France | 70/280 |
| 2508099 | 9/1976 | Germany | 292/DIG. 51 |
| 529533 | 6/1955 | Italy | 292/142 |

*Primary Examiner*—Lloyd A. Gall

[57] ABSTRACT

A motor driven locking mechanism including a door hingably coupled to a door frame at a first side edge thereof, the door having a horizontally orientated channel with a first open end situated on a second side edge of the door opposite the first side edge and a second closed end and a door knob rotatably coupled to the door about an axis which extends above and perpendicular to the channel; a first locking mechanism including a locking rod for slidably inserting within the channel, a strip gear longitudinally situated on a top edge of the locking rod, and a motor located adjacent the closed end of the channel having a rotor extending therefrom with a bevel gear coupled thereto, the bevel gear in threaded engagement with the strip gear for situating the locking rod in an extended orientation with the locking rod engaged with the door frame upon the receipt of a lock signal and a retracted orientation with the locking rod residing only within the channel upon the receipt of an unlock signal; and actuation mechanism adapted to selectively transmit an unlock signal to the motor and further selectively transmit a lock signal to the motor.

5 Claims, 3 Drawing Sheets

FIG 5
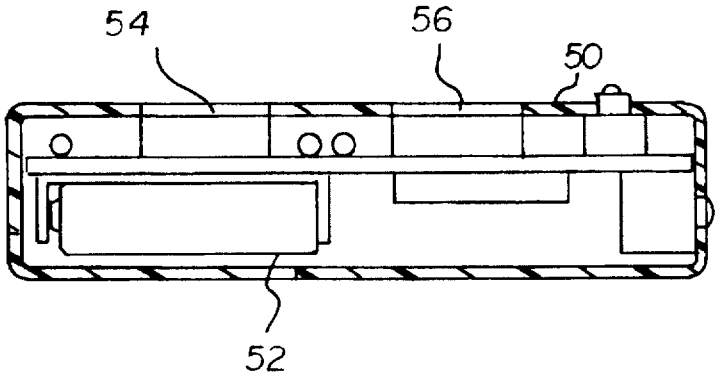
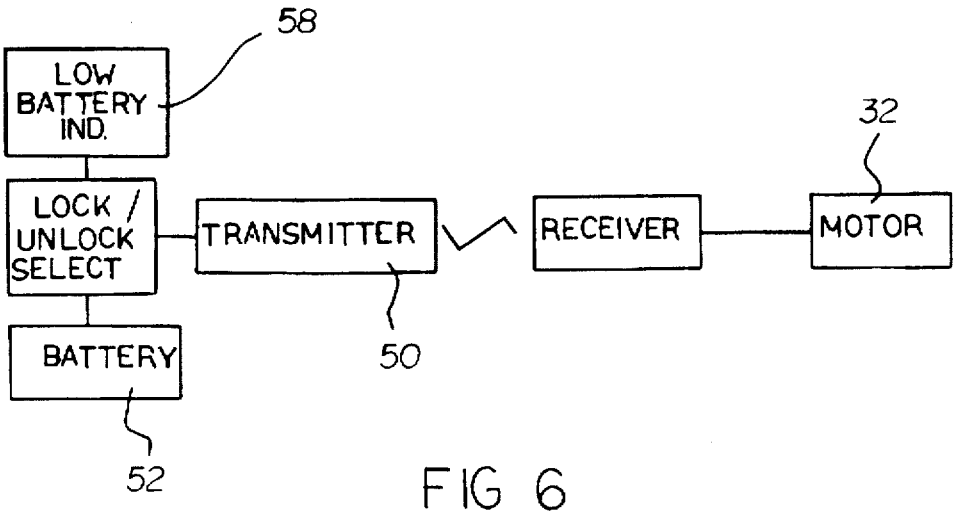
FIG 6

REMOTE CONTROL MOTOR DRIVEN LOCKING MECHANISM

BACKGROUND OF THE INVENTION

1. Field of the Invention

The present invention relates to a remote control motor driven locking mechanism and more particularly pertains to remotely locking a door and further precluding the rotation of an associated door knob upon the locking thereof.

2. Description of the Prior Art

The use of locking systems is known in the prior art. More specifically, locking systems heretofore devised and utilized for the purpose of locking doors, windows and the like are known to consist basically of familiar, expected and obvious structural configurations, notwithstanding the myriad of designs encompassed by the crowded prior art which have been developed for the fulfillment of countless objectives and requirements.

In this respect, the remote control motor driven locking mechanism according to the present invention substantially departs from the conventional concepts and designs of the prior art, and in so doing provides an apparatus primarily developed for the purpose of remotely locking a door and further precluding the rotation of an associated door knob upon the locking thereof.

Therefore, it can be appreciated that there exists a continuing need for a new and improved remote control motor driven locking mechanism which can be used for remotely locking a door and further precluding the rotation of an associated door knob upon the locking thereof. In this regard, the present invention substantially fulfills this need.

SUMMARY OF THE INVENTION

In view of the foregoing disadvantages inherent in the known types of locking systems now present in the prior art, the present invention provides an improved remote control motor driven locking mechanism. As such, the general purpose of the present invention, which will be described subsequently in greater detail, is to provide a new and improved remote control motor driven locking mechanism which has all the advantages of the prior art and none of the disadvantages.

To attain this, the present invention essentially comprises a door with a rectangular configuration having a front face, a rear face, and a periphery formed therebetween, the door hingably coupled to a door frame at a first side edge thereof, the door having a horizontally orientated channel with a first open end situated on a second side edge of the door opposite the first side edge and a second closed end and a door knob rotatably coupled to the door about an axis which extends above and perpendicular to the channel; a first locking mechanism situated between the front face and rear face of the door, the first locking mechanism including a pair of guides each with a generally U-shaped configuration each longitudinally positioned along opposite side edges of the channel, a locking rod having a pair of elongated protrusions situated on opposite side edges thereof for slidably inserting within the guides of the channel, a strip gear longitudinally situated on a top edge of the locking rod, and a motor located adjacent the closed end of the channel having a rotor extending therefrom with a bevel gear coupled thereto, the bevel gear in threaded engagement with the strip gear for situating the locking rod in an extended orientation with the locking rod engaged with the door frame upon the receipt of a lock signal and a retracted orientation with the locking rod residing only within the channel upon the receipt of an unlock signal; a second locking mechanism also situated between the front face and rear face of the door, the second locking mechanism including a vertically situated disk coupled to the axis about which the door knob rotates and further adapted to rotate coincidentally with the door knob, the disk having a plurality of notches formed on a periphery thereof, the second locking mechanism further including a pivot member situated adjacent the open end of the channel and further adjacent the disk and adapted to pivot about a horizontal axis, the pivot member having a first end having at least one notch situated thereon and a second bevelled end, whereby the pivot member has a first orientation with the at least one notch of the first end thereof residing distant from the disk upon the locking rod being in the retracted orientation thereof thus allowing the door knob to rotate and a second orientation with the at least one notch of the first end thereof engaging the disk upon the locking rod being in the extended orientation thereof thus precluding the door knob from being rotated; a receiver situated adjacent the motor between the front face and the rear face of the door, the receiver electrically connected to the motor and adapted to transmit an unlock signal thereto upon the receipt of an unlock transmission signal via free space and further adapted to transmit a lock signal thereto upon the receipt of a lock transmission signal via free space; and a transmitter with a compact rectangular configuration having a top face, a bottom face, and a periphery formed therebetween, the transmitter including a battery for powering purposes, an unlock button positioned on the top face thereof for deploying an unlock transmission signal via free space upon the depression thereof, a lock button positioned on the top face thereof for deploying a lock transmission signal via free space upon the depression thereof, and a light emitting diode positioned on the top face thereof adapted to actuate upon the battery strength falling below a predetermined level.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved remote control motor driven locking mechanism which has all the advantages of the prior art locking systems and none of the disadvantages.

It is another object of the present invention to provide a new and improved remote control motor driven locking mechanism which may be easily and efficiently manufactured and marketed.

It is a further object of the present invention to provide a new and improved remote control motor driven locking mechanism which is of a durable and reliable construction.

An even further object of the present invention is to provide a new and improved remote control motor driven locking mechanism which is susceptible of a low cost of manufacture with regard to both materials and labor, and which accordingly is then susceptible of low prices of sale to the consuming public, thereby making such remote control motor driven locking mechanism economically available to the buying public.

Still yet another object of the present invention is to provide a new and improved remote control motor driven locking mechanism which provides in the apparatuses and methods of the prior art some of the advantages thereof, while simultaneously overcoming some of the disadvantages normally associated therewith.

Still another object of the present invention is to remotely lock a door and further preclude the rotation of an associated door knob upon the locking thereof.

Lastly, it is an object of the present invention to provide a new and improved motor driven locking mechanism including a door hingably coupled to a door frame at a first side edge thereof, the door having a horizontally orientated channel with a first open end situated on a second side edge of the door opposite the first side edge and a second closed end and a door knob rotatably coupled to the door about an axis which extends above and perpendicular to the channel; a first locking mechanism including a locking rod for slidably inserting within the channel, a strip gear longitudinally situated on a top edge of the locking rod, and a motor located adjacent the closed end of the channel having a rotor extending therefrom with a bevel gear coupled thereto, the bevel gear in threaded engagement with the strip gear for situating the locking rod in an extended orientation with the locking rod engaged with the door frame upon the receipt of a lock signal and a retracted orientation with the locking rod residing only within the channel upon the receipt of an unlock signal; and actuation mechanism adapted to selectively transmit an unlock signal to the motor and further selectively transmit a lock signal to the motor.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a cross-sectional view of the transmitter taken along line 5—5 shown in FIG. 2.

FIG. 6 is a schematic of the circuitry employed in the present invention.

Similar reference characters refer to similar parts throughout the several views of the drawings.

DESCRIPTION OF THE PREFERRED EMBODIMENT

Figure 1:
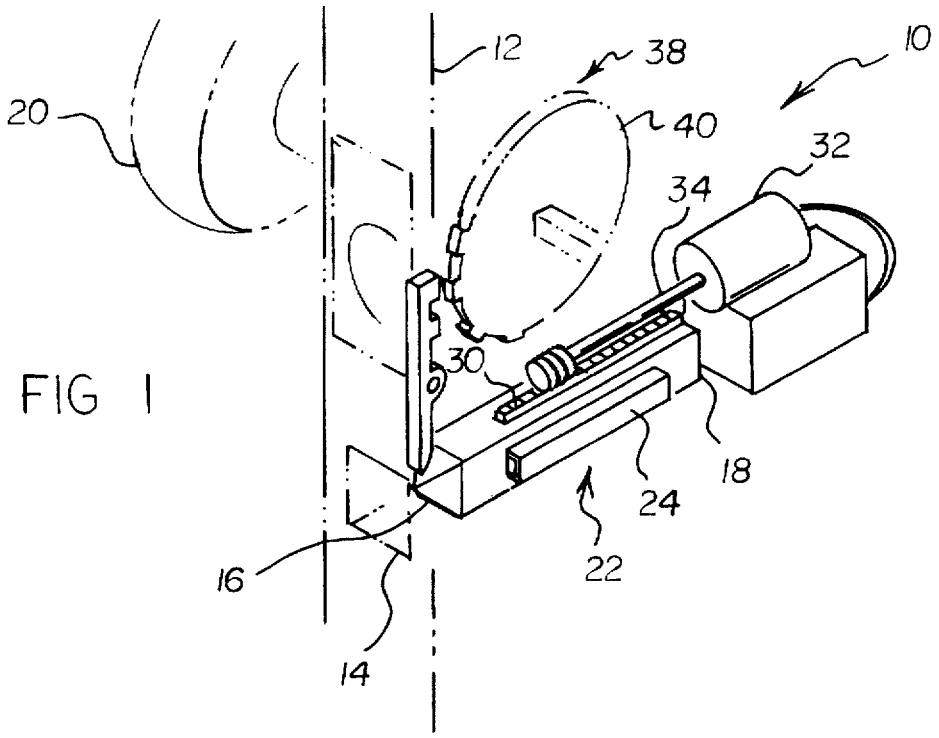
FIG. 1 is a perspective illustration of the preferred embodiment of the remote control motor driven locking mechanism constructed in accordance with the principles of the present invention.
Figure 2:
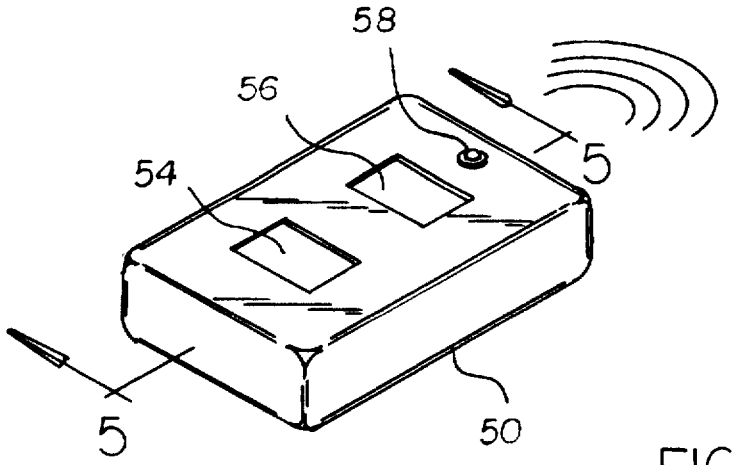
FIG. 2 is a perspective view of the transmitter utilized in the present invention.

With reference now to the drawings, and in particular to FIG. 1 thereof, a new and improved remote control motor driven locking mechanism embodying the principles and concepts of the present invention and generally designated by the reference numeral 10 will be described.

The present invention, the new and improved remote control motor driven locking mechanism, is comprised of a plurality of components. Such components in their broadest context include a door, first locking mechanism, second locking mechanism, receiver, and transmitter. Such components are individually configured and correlated with respect to each other so as to attain the desired objective.

More specifically, it will be noted that the system 10 of the present invention includes a door 12 with a rectangular configuration having a front face, a rear face, and a periphery formed therebetween. The door is hingably coupled to a door frame at a first side edge thereof. The door has a horizontally orientated channel 14. The channel has a first open end 16 situated on a second side edge of the door opposite the first side edge and a second closed end 18. A door knob 20 is rotatably coupled to the door about an axis which extends above and perpendicular to the channel.

Figure 4:
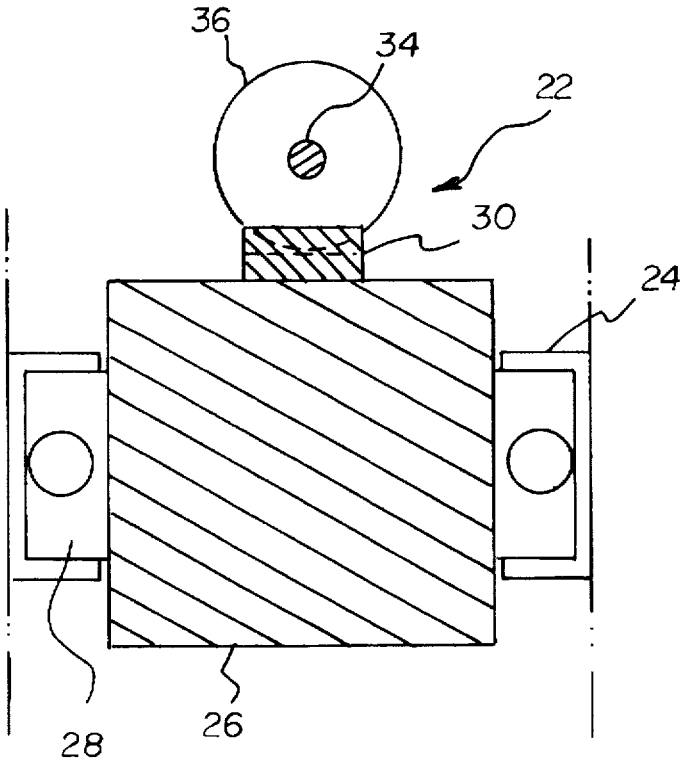
FIG. 4 is a cross-sectional view of the locking rod taken along line 4—4 shown in FIG. 3.

Further provided is a first locking mechanism 22 situated between the front face and rear face of the door. The first locking mechanism includes a pair of guides 24 each with a generally U-shaped configuration, as shown in FIG. 4. Each guide is longitudinally positioned along opposite side edges of the channel. A locking rod 26 has a pair of elongated protrusions 28 situated on opposite side edges thereof. In use, the protrusions slidably insert within the guides of the channel. Ball bearings are included to facilitate such sliding. A strip gear 30 is longitudinally situated on a top edge of the locking rod. Also included is a motor 32 located adjacent the closed end of the channel. Powering of the motor is preferably afforded via wires extending through the door and exiting therefrom at the first side edge thereof. Various commonly known contacts may also be employed in supplying power to the motor. The motor has a rotor 34 extending therefrom with a bevel gear 36 coupled thereto. The bevel gear is in threaded engagement with the strip gear. As such, the bevel gear is capable of situating the locking rod in an extended orientation with the locking rod engaged with the door frame. The motor allows the situating of the locking rod in such orientation only upon the receipt of a lock signal. Upon the receipt of an unlock signal, the locking rod is further situated in a retracted orientation with the locking rod residing only within the channel.

Figure 3:
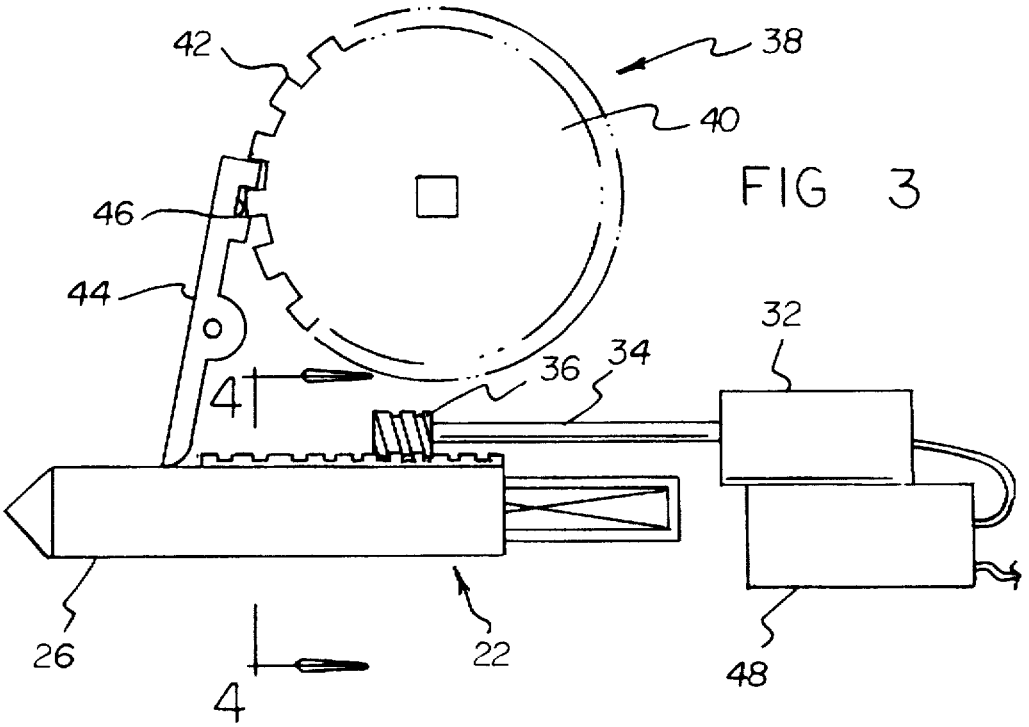
FIG. 3 is a side plan view of both the first locking mechanism and the second locking mechanism.

As best shown in FIG. 3, a second locking mechanism 38 is included. The second locking mechanism is situated between the front face and rear face of the door. The second locking mechanism includes a vertically situated disk 40 coupled with respect to the axis about which the door knob rotates. The disk is adapted to rotate coincidentally with the door knob. Formed on a periphery of the disk is a plurality of notches 42.

The second locking mechanism further includes a pivot member 44. The pivot member is situated adjacent the open end of the channel and further adjacent the disk. In operation, the pivot member is adapted to pivot about a horizontal axis. Ideally, the pivot member has a first end having at least one notch 46 situated thereon and a second bevelled end. Upon the locking rod being in the retracted orientation thereof, the pivot member has a first orientation, as shown in FIG. 1, with the at least one notch of the first end thereof residing distant from the disk. This allows the door knob to rotate freely. It should be noted that the pivot member, in the first orientation, is designed to reside in a vertical orientation. The pivot member further has a second orientation upon the locking rod being in the extended orientation thereof. To effect such, the locking rod, when extended, abuts the bevelled end of the pivot member and forces the notch of the first end to engage the disk thus precluding the door knob from being rotated.

Situated adjacent the motor is a receiver 48. The receiver is electrically connected to the motor. The receiver is adapted to transmit an unlock signal to the motor upon the receipt of an unlock transmission signal via free space. Upon the receipt of a lock transmission signal via free space, the receiver is adapted to transmit a lock signal thereto.

Finally, a transmitter 50 is included with a compact rectangular configuration having a top face, a bottom face, and a periphery formed therebetween. The transmitter includes a battery 52 for powering purposes. An unlock button 54 is positioned on the top face of the transmitter for deploying an unlock transmission signal via free space upon the depression thereof. A lock button 56 is positioned on the top face for deploying a lock transmission signal via free space upon the depression thereof. For indicating a low battery, a light emitting diode 58 is positioned on the top face and is adapted to actuate upon the battery strength falling below a predetermined level.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved remote control motor driven locking mechanism comprising, in combination:

a door with a rectangular configuration having a front face, a rear face, and a periphery formed therebetween, the door hingably coupled to a door frame at a first side edge thereof, the door having a horizontally orientated channel with a first open end situated on a second side edge of the door opposite the first side edge and a second closed end and a door knob rotatably coupled to the door about an axis which extends above and perpendicular to the channel;

a first locking mechanism situated between the front face and rear face of the door, the first locking mechanism including a pair of guides each with a generally U-shaped configuration each longitudinally positioned along opposite side edges of the channel, a locking rod having a pair of elongated protrusions situated on opposite side edges thereof for slidably inserting within the guides of the channel, a strip gear longitudinally situated on a top edge of the locking rod, and a motor located adjacent the closed end of the channel having a rotor extending therefrom with a bevel gear coupled thereto, the bevel gear in threaded engagement with the strip gear for situating the locking rod in an extended orientation with the locking rod engaged with the door frame upon the receipt of a lock signal and a retracted orientation with the locking rod residing only within the channel upon the receipt of an unlock signal;

a second locking mechanism also situated between the front face and rear face of the door, the second locking mechanism including a vertically situated disk coupled with respect to the axis about which the door knob rotates and further adapted to rotate coincidentally with the door knob, the disk having a plurality of notches formed on a periphery thereof, the second locking mechanism further including a pivot member situated adjacent the open end of the channel and further adjacent the disk and adapted to pivot about a horizontal axis, the pivot member having a first end having at least one notch situated thereon and a second bevelled end, whereby the pivot member has a first orientation with the at least one notch of the first end thereof residing distant from the disk upon the locking rod being in the retracted orientation thereof thus allowing the door knob to rotate and a second orientation with the at least one notch of the first end thereof engaging the disk upon the locking rod being in the extended orientation thereof thus precluding the door knob from being rotated;

a receiver situated adjacent the motor between the front face and the rear face of the door, the receiver electrically connected to the motor and adapted to transmit an unlock signal thereto upon the receipt of an unlock transmission signal via free space and further adapted to transmit a lock signal thereto upon the receipt of a lock transmission signal via free space; and a transmitter with a compact rectangular configuration having a top face, a bottom face, and a periphery formed therebetween, the transmitter including a battery for powering purposes, an unlock button positioned on the top face thereof for deploying an unlock transmission signal via free space upon the depression thereof, a lock button positioned on the top face thereof for deploying a lock transmission signal via free space upon the depression thereof, and a light emitting diode positioned on the top face thereof adapted to be actuated upon the battery strength falling below a predetermined level.

2. A motor driven locking mechanism comprising:

a door hingably coupled to a door frame at a first side edge thereof, the door having a horizontally orientated channel with a first open end situated on a second side edge of the door opposite the first side edge and a second closed end and a door knob rotatably coupled to the door about an axis which extends above and perpendicular to the channel;

a first locking mechanism including a locking rod for slidably inserting within the channel, a strip gear longitudinally situated on a top edge of the locking rod, and a motor located adjacent the closed end of the channel having a rotor extending therefrom with a bevel gear coupled thereto, the bevel gear in threaded engagement with the strip gear for situating the locking rod in an extended orientation with the locking rod engaged with the door frame upon the receipt of a lock signal and a retracted orientation with the locking rod residing only within the channel upon the receipt of an unlock signal;

actuation means adapted to selectively transmit an unlock signal to the motor and further selectively transmit a lock signal to the motor; and a second locking mechanism having a vertically situated disk coupled with respect to the axis about which the door knob rotates and further adapted to rotate coincidentally with the door knob, the disk having at least one notch formed on a periphery thereof, the second locking mechanism further including a pivot member situated adjacent the open end of the channel and further adjacent the disk and adapted to pivot about a horizontal axis, the pivot member having a first end having at least one notch situated thereon and a second bevelled end, whereby the pivot member has a first orientation with the at least one notch of the first end thereof residing distant from the disk upon the locking rod being in the retracted orientation thereof thus allowing the door knob to rotate and a second orientation with the at least one notch of the first end thereof engaging the disk upon the locking rod being in the extended orientation thereof thus precluding the door knob from being rotated.

3. A motor driven locking mechanism as set forth in claim 2 wherein the channel further includes a pair of guides and each with a generally U-shaped configuration each longitudinally positioned along opposite side edges of the channel and the locking rod has a pair of elongated protrusions situated on opposite side edges thereof for slidably inserting within the guides of the channel.

4. A motor driven locking mechanism as set forth in claim 2 wherein the actuation means includes a receiver electrically connected to the motor and adapted to transmit an unlock signal thereto upon the receipt of an unlock transmission signal via free space and further adapted to transmit a lock signal thereto upon the receipt of a lock transmission signal via free space and a transmitter including a battery for powering purposes, an unlock button positioned on a top face thereof for deploying an unlock transmission signal via free space upon the depression thereof, and a lock button positioned on the top face thereof for deploying a lock transmission signal via free space upon the depression thereof.

5. A motor driven locking mechanism as set forth in claim 4 wherein the transmitter has a light emitting diode positioned on the top face thereof adapted to be actuated upon the battery strength falling below a predetermined level.

* * * * *